US006206016B1

(12) United States Patent
MacNeil et al.

(10) Patent No.: US 6,206,016 B1
(45) **Date of Patent: *Mar. 27, 2001**

(54) SPRAY CLEANER FOR INTERIOR SURFACE OF PIPELINE

(75) Inventors: Gerard MacNeil, Surrey; David MacNeil, Langley; Gordon MacNeil, Delta; Vernon Bose, Langley, all of (CA)

(73) Assignee: Mac & Mac Hydrodemolition Inc., Surrey (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/126,113

(22) Filed: Jul. 30, 1998

(51) Int. Cl.[7] ..... B08B 3/02

(52) U.S. Cl. ..... 134/168 C; 134/167 C; 134/198; 239/743

(58) Field of Search ..... 134/166 C, 169 C, 134/168 C, 167 C, 201, 198; 15/302, 301, 321, 104.31, 340.1; 239/743, 165, 160, 722; 118/DIG. 10; 451/40

(56) References Cited

U.S. PATENT DOCUMENTS

| | | | | |
|---|---|---|---|---|
| 2,017,042 | * | 10/1935 | Dougherty | 134/167 C |
| 2,461,517 | * | 2/1949 | Carnevale | 134/167 C |
| 3,061,201 | * | 1/1962 | Brogden . | |
| 3,153,510 | * | 10/1964 | Brannfors et al. . | |
| 3,833,175 | * | 9/1974 | Pulk . | |
| 4,073,302 | * | 2/1978 | Jones | 134/167 C |
| 4,161,956 | * | 7/1979 | Hadgkiss | 134/167 C |
| 4,603,661 | * | 8/1986 | Nelson et al. | 134/167 C |
| 4,690,159 | * | 9/1987 | Vadakin et al. | 134/167 C |
| 5,004,156 | * | 4/1991 | Montanier . | |
| 5,018,545 | * | 5/1991 | Wells | 134/167 C |
| 5,020,188 | | 6/1991 | Walton . | |
| 5,052,423 | * | 10/1991 | Chapman et al. | 134/199 |
| 5,072,487 | * | 12/1991 | Walton | 134/167 C |
| 5,113,885 | * | 5/1992 | Ramsey | 134/168 C |
| 5,203,646 | * | 4/1993 | Landsberger et al. . | |
| 5,317,782 | * | 6/1994 | Matsuura et al. . | |
| 5,322,080 | * | 6/1994 | Rankin | 134/169 C |

(List continued on next page.)

FOREIGN PATENT DOCUMENTS

| | | | | |
|---|---|---|---|---|
| 0365921 A2 | | 5/1990 | (EP) . | |
| 2N499880 | * | 8/1982 | (FR) | 134/167 C |
| 2252807 | | 8/1992 | (GB) . | |
| 749458 | * | 7/1980 | (JP) | 134/167 C |
| 3-89986 | * | 4/1991 | (JP) | 134/167 C |
| 3-89987 | * | 4/1991 | (JP) | 134/167 C |
| 6-7754 | * | 1/1994 | (JP) | 134/167 C |
| 379295 | * | 7/1973 | (SU) | 134/167 C |

(List continued on next page.)

*Primary Examiner*—Frankie L. Stinson
(74) *Attorney, Agent, or Firm*—Hall, Priddy, Myers & Vande Sande

(57) ABSTRACT

This application discloses an automated apparatus for cleaning the interior surface of a pipe. The device includes a vehicle which propels itself down the inside of the pipe. A cleaning system is fixed to the vehicle and uses arms to reach the walls of the pipe. At the end of each arm sits a spray nozzle assembly equipped with spray nozzles. The spray nozzle assembly rotates or oscillates to spray clean the pipe surface. The arms and spray nozzle assembly interchange with other such cleaning systems depending on the shape or type of pipe and the desired cleaning technique. The apparatus is tethered to a source of fluid under pressure and a power source both of which are located off-board the apparatus at a remote location. An operator supervises the device's operation, controlling the speed and direction of travel of the vehicle, the speed and direction of oscillation and rotation of the cleaning system, and the fluid pressure delivered by the spray nozzles.

11 Claims, 9 Drawing Sheets

U.S. PATENT DOCUMENTS 5,522,677 * 6/1996 Schlect .
5,561,883 10/1996 Landry et al. .
5,851,580 * 12/1998 Amberg et al. .

FOREIGN PATENT DOCUMENTS

597441 * 3/1978 (SU) ..... 134/167 C
WO
98/807532 2/1998 (WO) .

* cited by examiner

SPRAY CLEANER FOR INTERIOR SURFACE OF PIPELINE

FIELD OF THE INVENTION

The present invention relates to a device for cleaning the interior surface of a pipe and more specifically for cleaning the interior surface of a sewer pipe.

BACKGROUND OF THE INVENTION

Pipes used to carry liquids and gases commonly transport all types of materials including water, natural gas, solid and liquid sewage, as well as various other accumulations from the pipe. Over time, these pipes require servicing and cleaning. Taylor et al. disclose automated systems for cleaning the outside of a pipeline in U.S. Pat. No. 5,520,734. Taylor et al. excavate under subterranean pipe and restore it by first cleaning the pipe and then applying a protective coating to the outer surface. As yet, however, nobody has automated a process for cleaning or restoring the inside of a pipe.

The interior surface of a pipeline carrying solids, liquids and gases generally degrades over time as the pipe walls interact chemically and physically with the substances flowing through them. In particular, a sewer system's interior walls corrode and deteriorate because corrosive materials contaminate the surface degrading the metal and concrete used to build the sewer. The corrosive material arises from both the sewage and waste water itself, and also from the digestive by-products of bacteria found in the sewage which proliferate in the anaerobic environment. The corrosion causes the walls of the sewer pipe to physically decay, eventually reducing their overall thickness.

The principal source of corrosion is sulfuric acid, which arises as a product of the materials transported in a sewer pipe and the sewer environment itself. Various metal sulfates found in the sewage quickly convert into hydrogen sulfide by: reducing to sulfide ions in the waste water, combining with hydrogen in the water and outgassing above the liquid as hydrogen sulfide gas. Additional hydrogen sulfide originates from bacteria containing contaminants which accumulate on the relatively rough concrete below the maximum liquid level. Bacteria found in these accumulations thrive in the anaerobic sewer environment producing hydrogen sulfide gas as a respiratory bi-product. Oxygen from the liquid below and oxygen condensing from the water in the air react with the hydrogen sulfide on the pipeline walls creating the highly corrosive sulfuric acid. The sulfuric acid attacks the calcium hydroxide in the concrete sewer walls leaving calcium sulfates which ultimately crumble and fall off of the interior of the wall substantially reducing its thickness.

The waste water level varies over the course of a 24 hour period. The flow is at its lowest level between 1:00 AM and 6:00 AM in the morning but it rises distinctly in the daytime and the pipe may operate near capacity. Because of the gaseous nature of the hydrogen sulfide, the pipe walls are predominately corroded in the portions of the wall above the minimum liquid level. Portions of the walls which are always below the water level are not subjected to such high concentrations of hydrogen sulfide gas or sulfuric acid and consequently do not experience the same levels of decay.

Eventually the sewer walls must be restored or they can suffer permanent damage leading to great expense. The restoration process is a two step operation that consists of first cleaning all of the contaminants (including any possibly existing outer layers of corrupted concrete) from the surface of the pipe, i.e. a process herein defined as scarifying, and then applying a protective coating over the newly cleaned (scarified pipe surface. Attempting to apply a protective coating without as aforesaid first cleaning the pipe surface is futile because it does not stop the decay that has already began underneath the coating. Furthermore, the protective coating itself does not adhere well to the contaminated surface. Thus, cleaning is an essential element of the restoration process.

As previously mentioned, a sewer system typically operates at high capacity during the day with decreasing flow overnight. In order to restore the sewer pipes without diverting the flow (a costly and sometimes impossible alternative), a bulk of the work must be done at night during the brief period when the flow is at a minimum. As previously outlined, the restoration process involves both cleaning the pipe surface and applying a protective coat. In practice, the rate of restoration is impaired because manual cleaning takes a proportionally greater amount of time than does the application of the protective coat. Consequently, a need exists for an automated cleaning process. Such a process will improve the rate of cleaning of the pipeline's interior walls making restoration without diversion a cost-effective possibility. Further, automation of the process can help to ensure that the same intensity of cleaning is applied to the entire surface without the quality variation that is inherent in manual execution.

Several patents such as Taylor et al. (U.S. Pat. No. 5,520,734), describe automated processes for cleaning the outside surface of pipelines using spray nozzle jets; however, none have attempted to automate the cleaning of the interior surface of a pipeline.

SUMMARY OF THE INVENTION

The following is a brief description of the invention, its parts and its functionality.

The present invention is a two part system for cleaning the interior surface of a pipe which includes a "vehicle" which can move along the interior of the pipe and a "cleaning system" attached to that vehicle. As the vehicle moves, the cleaning system cleans a selected region of the interior surface of the pipe.

At its most basic level, the cleaning system may include a fluid coupler with a flow control valve which is coupled between a source of pressurized fluid and a spray nozzle. The spray nozzle may direct a jet of pressurized fluid against the interior surface of said pipe.

The cleaning system may be further described in terms of an "arm" mounted at one end to the vehicle chassis, a "spray nozzle assembly" rotatably mounted to the arm, and an "exchanger" coupled between the fluid coupler with the flow control valve and the spray nozzle assembly. The cleaning system arm and/or spray nozzle assembly may be adjustable so as to position said spray nozzle assembly in proximity to the interior surface of the pipe. The exchangers may distribute fluid from the fluid coupler with the flow control valve to the parts of the spray nozzle assembly.

The spray nozzle assembly may further comprise a plurality of branches which may be rotatably attached to said exchanger. The branches may be rotatable about a common axis and may conduct fluid from the exchanger. Each of the branches may be equipped with at least one spray nozzle. The spray nozzles may be operative to receive pressurized fluid from the branches and expel it against the interior surface of the pipe.

The apparatus is adaptable to clean the interior surface of the pipe in many different fashions. A first cleaning system is adjustable so that one of the arm and/or the spray nozzle assembly is positionable so as to locate the nozzles adjacent to the interior surface of the pipe and to clean a longitudinal swath of the pipe in a direction of travel of the vehicle. Alternatively, the cleaning system arm and/or spray nozzle assembly may be configured so as to rotate about an axis substantially parallel to the longitudinal axis of the pipe, so that the pressurized fluid expelled from the nozzles impacts an entire circumferential swath of the pipe's interior surface. The arm and/or spray nozzle assembly may also be positionable so as to locate the nozzles adjacent to a bottom surface of the pipe. The pressurized fluid expelled by the nozzles may then clean a longitudinal swath along the bottom surface of the pipe.

The vehicle may comprise a chassis which may be adjustable to fit various pipe sizes an may support the apparatus, a track assembly which may propel the vehicle along a longitudinal direction of the pipe as it rotates, a motor mounted on the apparatus and coupled so as to drive the track assembly, and a power coupler mounted on the chassis which conducts power to the apparatus. The power source may be any type of power, but preferably, the source may be electric or hydraulic. Advantageously, the power source may be located on-board the apparatus or may be at an off-board location remote from the vehicle.

The vehicle may further comprise a mechanical, electric or electromechanical appliance which controls the power coupler and the motor in such a manner as to control the speed and direction of motion of the vehicle. The appliance may be manipulated by user input which may be direct or may come from a remote source.

The power coupler may provide power to an actuator. The actuator may be used to move the cleaning system with respect to the vehicle. The apparatus may include a second mechanical, electric, or electromechanical appliance which controls the actuator in such a manner as to control the speed and direction of the cleaning system as it moves with respect to the vehicle. Again, the appliance may be manipulated by user input which may be direct or may come from a remote source. The actuator may move the cleaning system in a manner which is fully rotational, oscillatory, or both rotational and oscillatory.

In a case where there is no powered actuator, the exchanger may use energy from the pressurized fluid to move the cleaning system with respect to the vehicle. The apparatus may then include a third mechanical, electric, or electromechanical appliance which controls the exchanger in such a manner as to control the speed and direction of the cleaning system as it moves with respect to the vehicle. Again, the appliance may be manipulated by user input which may be direct or may come from a remote source. The exchanger may move the cleaning system in a manner which is fully rotational, oscillatory, or both rotational and oscillatory.

Advantageously, the vehicle may be equipped with guiding bars affixed to the chassis at one end and having wall engaging attachments which move along the interior surface of the pipe and maintain the orientation of the vehicle along a longitudinal axis of the pipe. Preferably the guiding bars are adjustable so as to extend from the vehicle to the interior surface of the pipe.

The vehicle may be equipped with a cab to safely hold a human operator.

In a second aspect of this invention, there is provided an apparatus for spraying the interior surface of a pipe. The apparatus includes a vehicle and a spraying system. The vehicle may be adapted for travel along a longitudinal direction of the interior of the pipe and the spraying system, connected at one end to the vehicle, may move with respect to the vehicle and thereby apply spray to a selected region of the pipe's interior surface as the vehicle travels longitudinally along the inside of the pipe.

In another aspect of the invention, there is provided a method of spraying an interior surface of a pipe which may involve propelling an apparatus along the interior of the pipe parallel to the pipe's longitudinal axis. As the apparatus travels, a spraying system mounted to the vehicle may spray fluid onto the pipeline's interior surface. The spraying system may be circulated about the vehicle as the vehicle travels along the longitudinal axis. The circulation may be such that the spraying is completed over any desired portion of the pipe's interior surface.

The circulating step described above may be implemented by several different methods depending on the shape of the pipe and the desired spraying technique. If 360° spraying is required, then the spraying system may be rotated along an inner circumferential path of the pipe's interior surface during the aforementioned propelling step (i.e. while the apparatus propels itself longitudinally along the pipe). Complete spraying of the 360° surface may be accomplished in a single pass. Alternatively, the spraying system may be oscillated or both oscillated and rotated along an inner circumferential path of the pipe's interior surface during the aforementioned propelling step. Again complete 360° spraying may be accomplished in a single pass. If only an upper portion of the pipe's interior surface requires spraying, then an alternative multi-pass circulating technique may be required. The spraying system may be rotated about an arm perpendicular to the pipe's longitudinal axis during the aforementioned propelling step. The arm may then be pivoted in a direction perpendicular to the pipe's longitudinal axis and the process may be repeated over a number of passes so as to complete spraying over the entire surface. Alternatively, the same procedure may be employed, except that the spraying system oscillates about the arm.

The spraying method discussed above may be used to coat or clean the interior surface of a pipe by expelling pressurized fluid onto the pipe's interior walls. This expelling step may be accomplished by a plurality of spray nozzles and may clean contaminants from the interior surface of the pipe.

DESCRIPTION OF THE PREFERRED EMBODIMENT

The four embodiments envisaged in this invention are outlined below with reference to the drawings.

The First Embodiment

Figure 1:
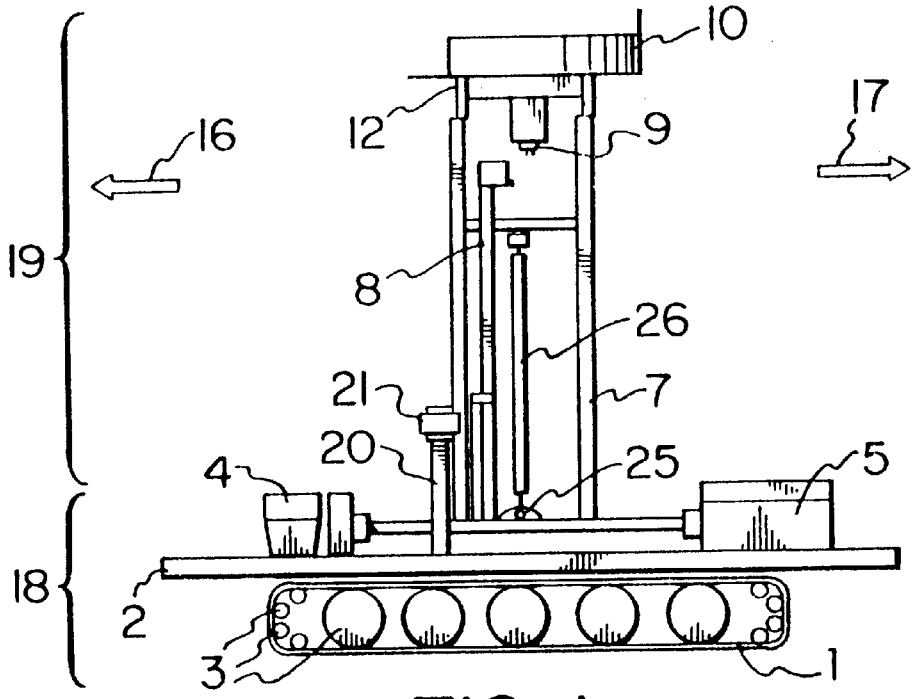
FIG. 1 is a side view of the first embodiment showing the vehicle and the cleaning system consisting of the arm and the spray nozzle assembly.
Figure 2:
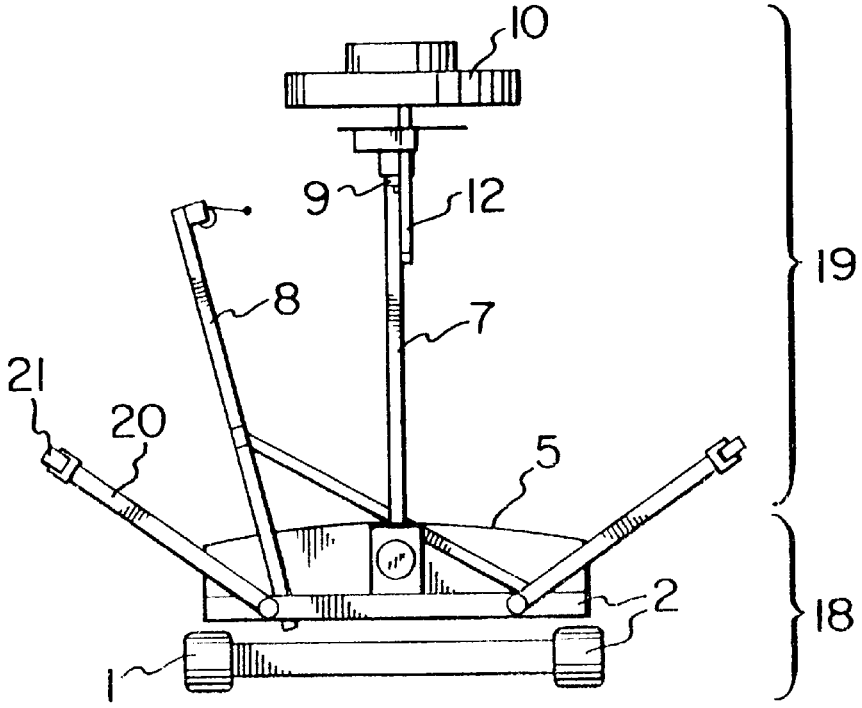
FIG. 2 is a front view of the first embodiment showing the arm in a vertical orientation.
Figure 3:
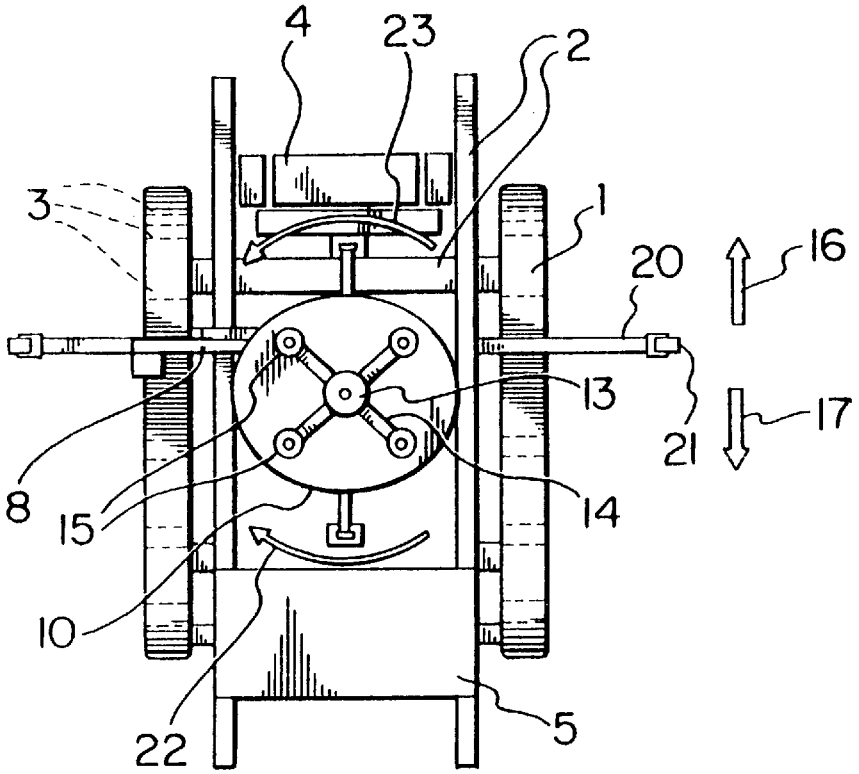
FIG. 3 is a top view of the first embodiment. The arm is a vertical orientation giving a clear view of the spray nozzle assembly.
Figure 4:
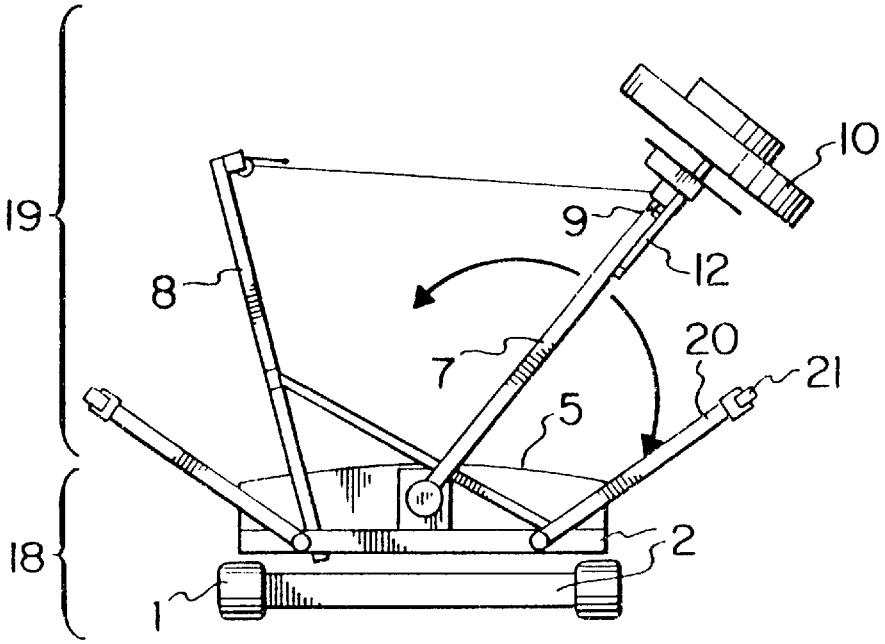
FIG. 4 is a front view of the first embodiment showing the arm extended at a radial angle to reach the interior surface of the pipe.
Figure 8:
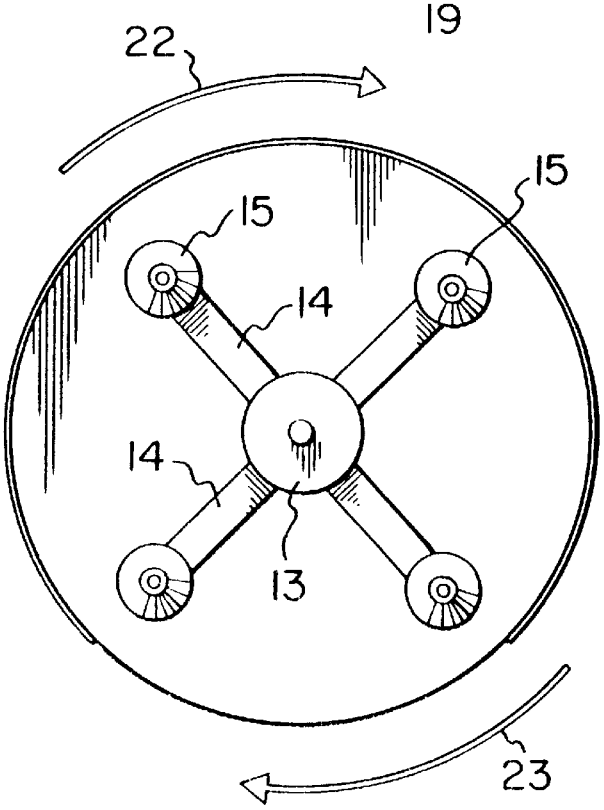
FIG. 8 is a top view of the spray nozzle assembly used in the first and third embodiments. Shown clearly, are the symmetrical branches holding the spray nozzles.
Figure 9:
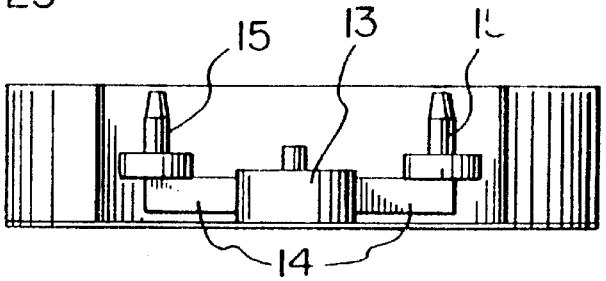
FIG. 9 is a side view of the spray nozzle assembly used in the first and third embodiments. Shown clearly, is the vertical orientation of the spray nozzles.

The first embodiment of the apparatus for spraying clean the interior surface of a pipeline is depicted in FIGS. 1–4. FIGS. 1–3 depict side, front and top views respectively of the first embodiment with the arm 7 oriented in a vertical position. FIG. 4 depicts a front view of the apparatus with the arm 7 at a transverse angle. The spray nozzle assembly 10 of the first embodiment is depicted in FIGS. 8 and 9.

The apparatus comprises a vehicle 18 that propels itself along a longitudinal direction inside of a pipe, cleaning the interior surface as it travels. The apparatus is equipped with a cleaning system 19 comprising an arm 7 and a spray nozzle assembly 10. The cleaning system 19 extends from the vehicle to the wall of the conduit and uses spray nozzles to clean the (which, as aforesaid, includes scarifying) pipe surface.

The vehicle 18 includes a chassis 2 which moves longitudinally along the bottom floor of the pipe on its track assembly 1. The tracks 1 are propelled along rollers 3 by a hydraulic motor (not shown) sitting on board the chassis 2. Although tracks 1 are included in this description of the preferred embodiment, any actuator capable of moving the vehicle 18 under power from the hydraulic motor will suffice. The hydraulic motor is powered by an external hydraulic reservoir (not shown) coupled to the apparatus by a hydraulic coupler (not shown) also mounted on the chassis 2. It will be noted that, although a hydraulic motor is used in this embodiment, that any power providing means, both external or on-board but preferably exhaustless, may be used for this application. The direction of motion of the vehicle is that of arrow 16 or 17. An on-board battery 4 powers hydraulic switches (not shown) which control the speed and direction of motion of the vehicle. The motor, hydraulic coupler and hydraulic switches are covered with plate 5 to protect their sensitive parts from debris dislodged during cleaning. When spray nozzles 15 are employed to clean the walls of the conduit, recoil forces may tend to disturb the vehicle trajectory. Accordingly, a number of guiding bars 20 may be attached to the chassis 2 of the vehicle 18 and telescopically extend to the walls of the pipeline. The guiding bars' wall engaging attachments 21 move along the pipe's walls and prevent the vehicle 18 from deviating from its path.

The cleaning system 19 consists of a telescoping arm 7 and a spray nozzle assembly 10. The arm 7 includes two telescoping pipes in which the upper portion of the pipe 12 has a smaller diameter such that it slides down into the lower portion. The piston 26 controls the extension of the telescoping arm 7. This combination of telescoping parts permits the arm 7 to be extended or contracted depending on the diameter of the pipe surface to be cleaned. The arm 7 pivots on hinge 25 in a lateral direction so that it can reach any transverse angle between 0° and 180°. Consequently, the device can manipulate the cleaning system 19 so that the spray nozzle assembly 10 is in close proximity to the pipe walls. Since this embodiment contains only one arm 7, a stabilizing bar 8 is used to counteract the weight of the arm 7 as it is extended radially.

The cleaning system 19 may be easily removed from the chassis 2 of the vehicle 18 in order to reduce the size of the apparatus so as to enter a sewer system through a small aperture such as a manhole. Furthermore, the width of the chassis 2 (i.e. separation between tracks 1) can be adjusted so as to position the vehicle 18 longitudinally in pipes of various sizes.

The spray nozzle assembly 10 is mounted at the distal end of the arm's 7 telescoping pipes. Fluid coupler 9 with a flow control valve is attached to an external source of fluid under pressure (not shown) which is fed into exchanger/actuator 13. Referring to FIG. 8, exchanger/actuator 13 causes the spray nozzle assembly 10 to rotate or oscillate and distributes the fluid to each branch 14 of the spray nozzle assembly 10. The direction of rotation is indicated by arrows 22 and 23. The actual spray nozzles 15 are jets aimed into the pipeline walls. The spray nozzles 15 discharge fluid to clean the interior surface of the pipe. The drawings show one spray nozzle 15 attached to each branch 14, but it should be obvious to one skilled in the art that a plurality of nozzles 15 may be coupled to each branch 14.

Figure 13:
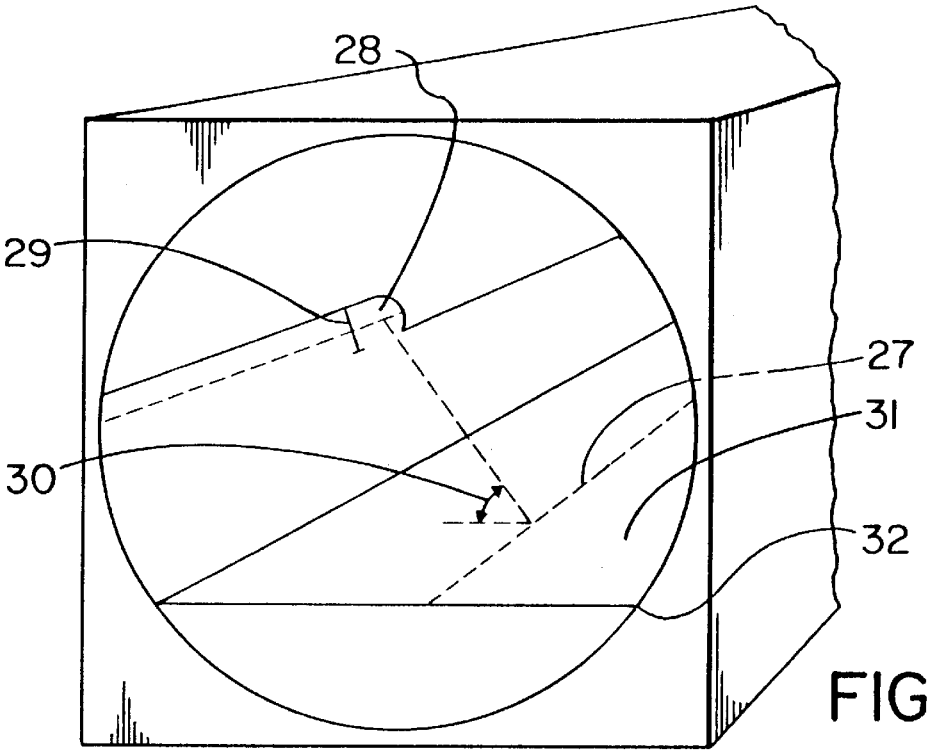
FIG. 13 depicts the swath cleaned by the first embodiment showing how several passes are required to clean the entire pipe.

Referring now to FIGS. 4 and 13, as the vehicle 18 travels up the center of the pipe floor 27, the cleaning system 19 cleans a swath of the pipe wall 28. The swath is approximately the same width 29 as the diameter of the spray nozzle assembly 10 and is centered approximately at the arm angle 30. Fully cleaning the interior surface of the pipe requires that the vehicle 18 make several passes back and forth, changing the arm angle 30 with each pass. The vehicle chassis is outfitted with a drawbar (not shown) which holds the hydraulic and pressurized fluid tethers away from the apparatus so that it may easily travel forwards or reverse without running over the tethers.

An additional safety feature not shown in the drawings is a "deadman" which is a safety switch operative to cut off the high pressure from the moving parts of the cleaning system 19. The deadman is useful in both emergency situations and when minor adjustments must be made to the apparatus during a job.

This apparatus is the preferred embodiment when the conduits or pipes are not perfectly cylindrical in shape (i.e. they are some other shape such as semicircular in cross section). This embodiment can also be used for a cylindrical pipe when flow diversion is impossible. A false floor 31 is layered on top of the minimum flow mark 32 and the cleaning is performed above the false floor 31. Since most of the corrosion occurs in levels above the minimum liquid level 32, this cleaning method is acceptable for restoration applications.

The Second Embodiment

Figure 5:
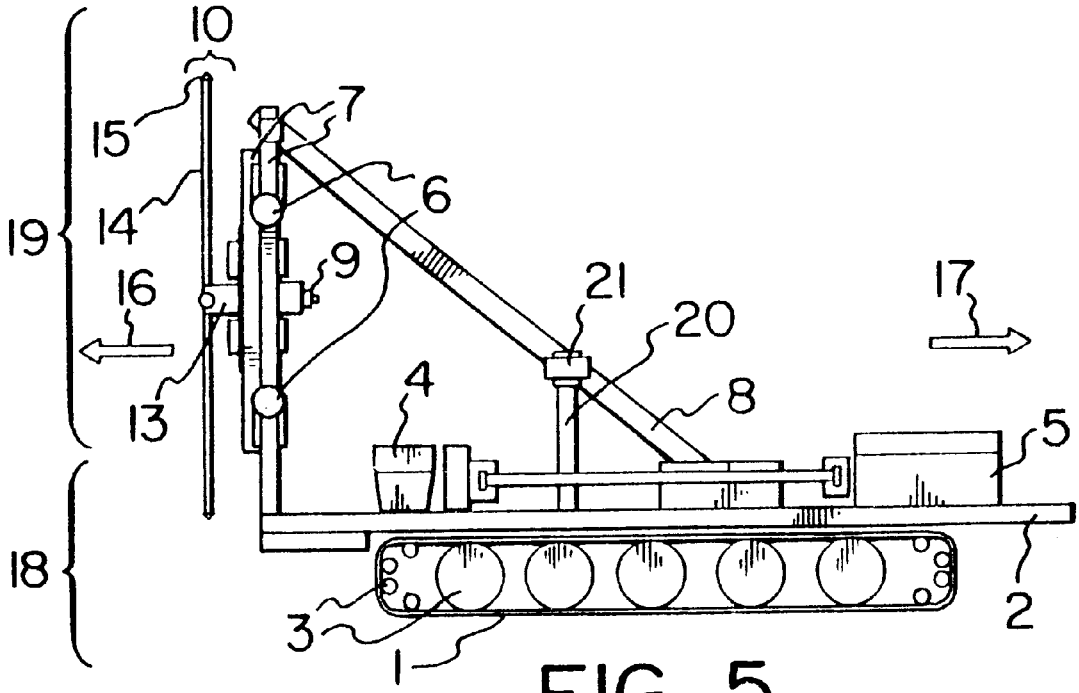
FIG. 5 is a side view of the second embodiment showing the arm mounted vertically on the front of the vehicle and the branches of the spray nozzle assembly pointing radially at the pipe surface.
Figure 6:
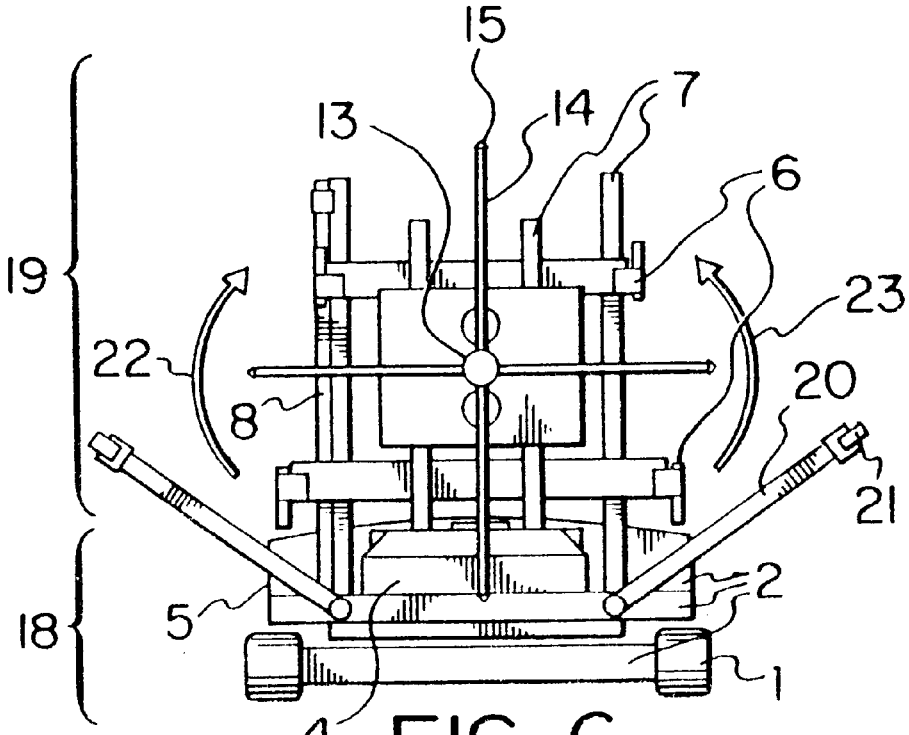
FIG. 6 is a front view of the second embodiment showing the arm mounted vertically on the front of the vehicle and the branches of the spray nozzle assembly pointing radially at the pipe surface.
Figure 7:
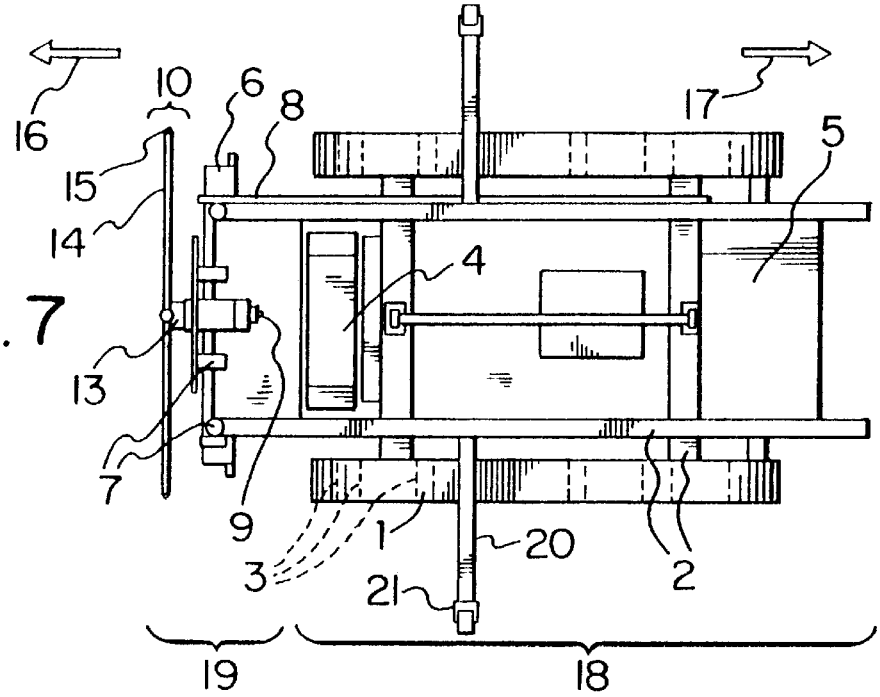
FIG. 7 is a top view of the second embodiment.

The second embodiment of the spray cleaner for the interior surface of a pipeline is depicted in FIGS. 5–7. The figures depict side, front and top views respectively of the second embodiment with the arm 7 mounted on the front of the vehicle.

As with the first embodiment, the apparatus comprises a vehicle 18 that propels itself along a longitudinal direction inside of a pipe, cleaning the interior surface as it travels. The apparatus is equipped with a cleaning system 19 including an arm 7 and a spray nozzle assembly 10. The cleaning system 19 extends from the vehicle 18 to the wall of the conduit and uses spray nozzles 15 to clean the pipe surface.

The vehicle 18 is the same as the first embodiment and includes a chassis 2 which moves longitudinally along the bottom of the pipe floor on its track assembly 1. The tracks 1 are propelled along rollers 3 by a hydraulic motor (not shown) sitting on board the chassis 2. Although tracks 1 are included in this description of the preferred embodiment, any actuator capable of moving the vehicle 18 under power from the hydraulic motor will suffice. The hydraulic motor is powered by an external hydraulic reservoir (not shown) coupled to the apparatus by a hydraulic coupler (not shown) also mounted on the chassis 2. It will be noted that, although a hydraulic motor is used in this embodiment, that any power providing means, both external or on-board but preferably exhaustless, may be used for this application. The direction of motion of the vehicle 18 is that of arrow 16 or 17. An on-board battery 4 powers hydraulic switches (not shown) which control the speed and direction of motion of the vehicle. The motor, hydraulic coupler and hydraulic switches are covered with plate 5 to protect their sensitive parts from debris dislodged during cleaning. When spray nozzles 15 are employed to clean the walls of the conduit, recoil forces may tend to disturb the vehicle trajectory. Accordingly, a number of guiding bars 20 may be attached to the chassis 2 of the vehicle 18 and telescopically extend to the walls of the pipeline. The guiding bars' wall engaging attachments, 21 move along the pipe's walls and prevent the vehicle 18 from deviating from its path. Once again, the vehicle 18 may be adjusted in width by adjusting the chassis 2, so as to position the vehicle 18 longitudinally in pipes of various sizes. Similarly to the first embodiment, the vehicle chassis 2 is equipped with a drawbar (not shown) to hold the hydraulic and high pressure fluid tethers away from the vehicle 18.

In the second embodiment, the cleaning system 19 consists of a vertical arm 7 attached to the front of the chassis 2 and a spray nozzle assembly 10. The entire cleaning system 19 may be easily removed from the chassis 2 of the vehicle 18 in order to reduce the size of the apparatus so as to enter a sewer system through a small aperture such as a manhole. The arm 7 includes adjusters 6 which raise the fluid coupler 9 at the center of the spray nozzle assembly 10 to align it roughly with the center of the pipe. This alignment permits even spray on all portions of the pipeline walls. The arm 7 has a stabilizing bar 8 which helps to counteract the weight of the arm 7 in front of the vehicle 18.

The spray nozzle assembly 10 attaches to the vertical arm 7. Fluid coupler 9 with a flow control valve is attached to an external source of fluid under pressure (not shown). The fluid is fed into exchanger/actuator 13. Referring to FIG. 6, exchanger/actuator 13 causes the spray nozzle assembly to rotate or oscillate and distributes the fluid to each branch 14 of the spray nozzle assembly 10. The direction of rotation of the spray nozzle assembly 10 is indicated by arrows 22 and 23. The branches 14 are laterally extendible so as to bring the spray nozzles 15 (which are mounted on the ends of the branches 14) into proximity of the pipeline walls and direct them at the wall's interior surface. The spray nozzles 15 discharge fluid to clean the interior surface of the wall. Again it is understood as being obvious to one skilled in the art, that there may be a number of nozzles 15 for each branch 14.

As the vehicle 18 travels longitudinally along the center of the pipe floor in a direction indicated by arrows 16 and 17, the cleaning system 19 cleans a transverse circumferential line along the interior of the pipe wall. Unlike the swaths in the first embodiment, this apparatus is capable of cleaning the entire interior surface in a single pass through the pipe. However, because a significantly larger area is being cleaned, the vehicle 18 must travel more slowly than it does in the first embodiment ensuring adequate coverage of the walls.

An additional safety feature not shown in the drawings is a "deadman" which is a safety switch operative to cut off the high pressure from the moving parts of the cleaning system 19. The deadman is useful in both emergency situations and when minor adjustments must be made to the apparatus during a job.

This apparatus is preferred over the first embodiment when the conduits or pipes are cylindrical in shape and the entire 360° circumference of the pipe is being cleaned.

The Third Embodiment

Figure 10:
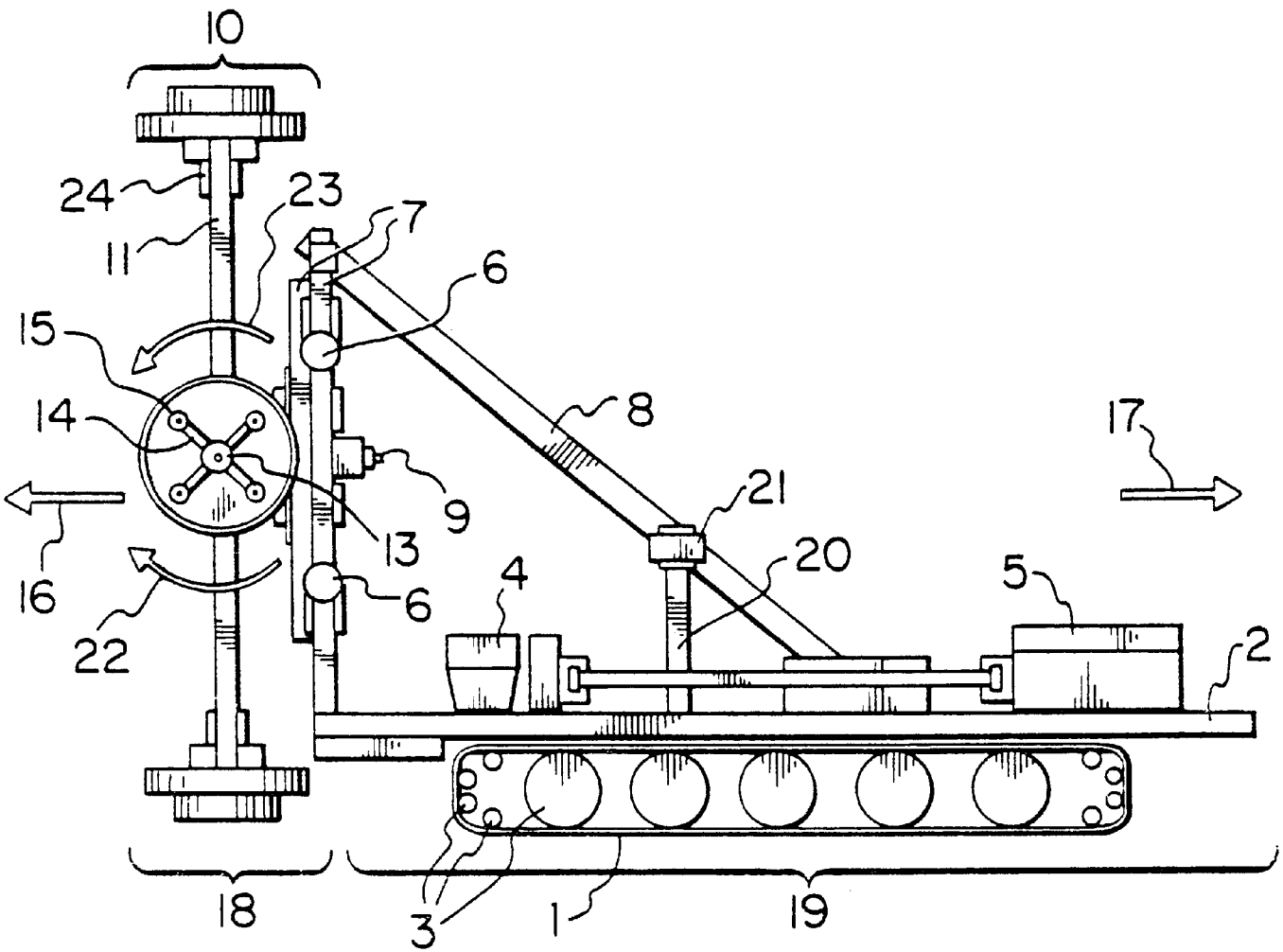
FIG. 10 is a side view of the third embodiment showing the principal arm and the subsidiary arms holding the spray nozzle assemblies. The spray nozzle assemblies are the type shown in FIG. 8.
Figure 11:
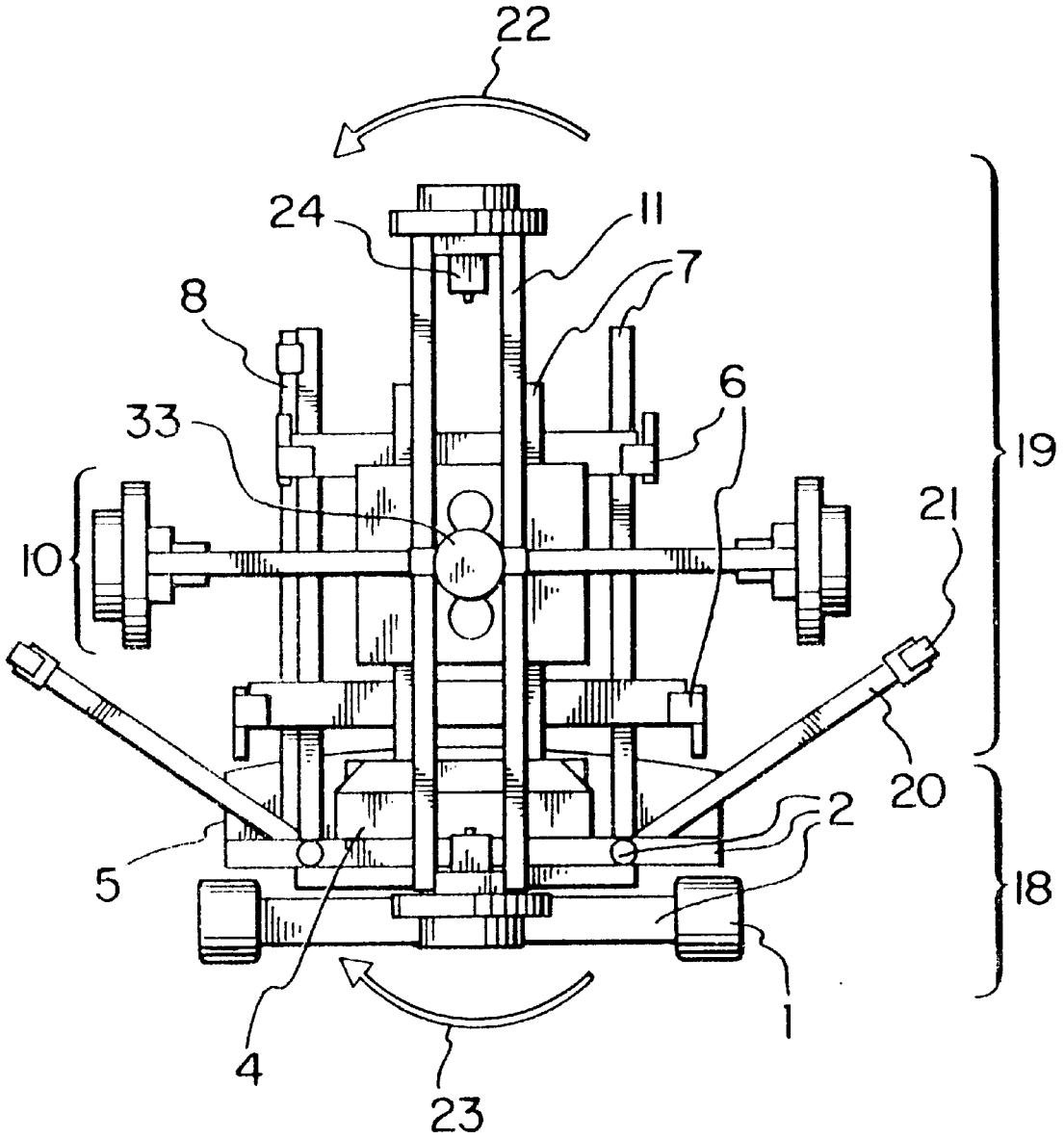
FIG. 11 is a front view of the third embodiment showing the principal arm and the subsidiary arms holding the spray nozzle assemblies. The spray nozzle assemblies are the type shown in FIG. 8.
Figure 12:
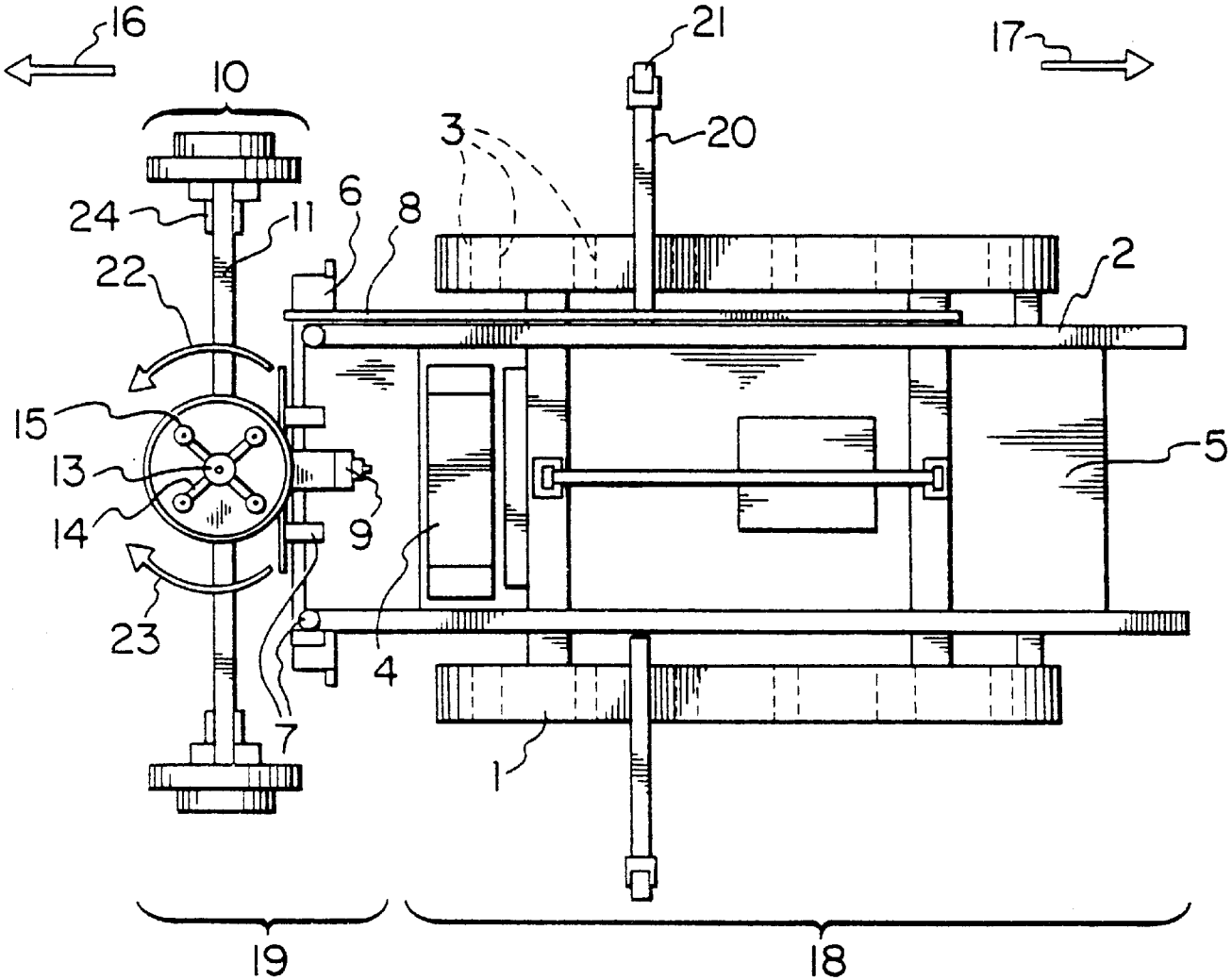
FIG. 12 is a top view of the third embodiment.

The third embodiment is a combination of the first and second embodiments and is depicted in FIGS. 10–12, which show side, front and top views, respectively. The principal arm 7 is connected to the front of the chassis 2 as in the second embodiment, but the spray nozzle assemblies 10 are that of the first.

The vehicle 18, chassis 2, motor (not shown), guiding bars 20, guiding bar attachments 21, battery 4, hydraulic coupler, deadman and drawbar (not shown) are substantially the same as that of the first two embodiments. The cleaning system 19, however, is considerably different. The principal arm 7 is oriented vertically and is essentially the same as the arm in the second embodiment, but it has a plurality of additional subsidiary arms 11 which extend transversely from the center of the principal arm 7. The adjusters 6 move vertically to align the center of the subsidiary arms 11 with the center of the pipe. The subsidiary arms 11 are telescopically adjustable so that they can extend transversely to the inner surface of the pipeline walls. A fluid coupler 9 with flow control valve receives fluid under pressure from an external source (not shown). An exchanger/actuator 33 simultaneously rotates or oscillates the subsidiary arms 11 and distributes the fluid. At the end of each subsidiary arm 11 is a spray nozzle assembly 10 that is basically the same as that of the first embodiment. Each spray nozzle assembly 10 has a secondary fluid coupler 24, an exchanger/actuator 13, symmetrical branches 14, and spray nozzles 15.

The vehicle 18 travels longitudinally along the center of the pipe in a direction indicated by arrows 16 or 17, while the subsidiary arms 11 rotate or oscillate in the direction of arrow 22 or 23, moving the spray nozzle assemblies 10 laterally across the inner circumference of the pipeline wall. The spray nozzle assemblies 10 are simultaneously rotating or oscillating such that they are cleaning a swath similar to the first embodiment, but the swath is laterally oriented.

The third embodiment (like the second) is most useful for cleaning the entire circumference of the interior of a cylindrical pipe. However, the wide swath enabled by incorporating the spray nozzle assembly 10 from the first embodiment permits the vehicle 18 to travel faster down the pipeline floor and still maintain adequate coverage of the walls.

The Fourth Embodiment

Figure 14:
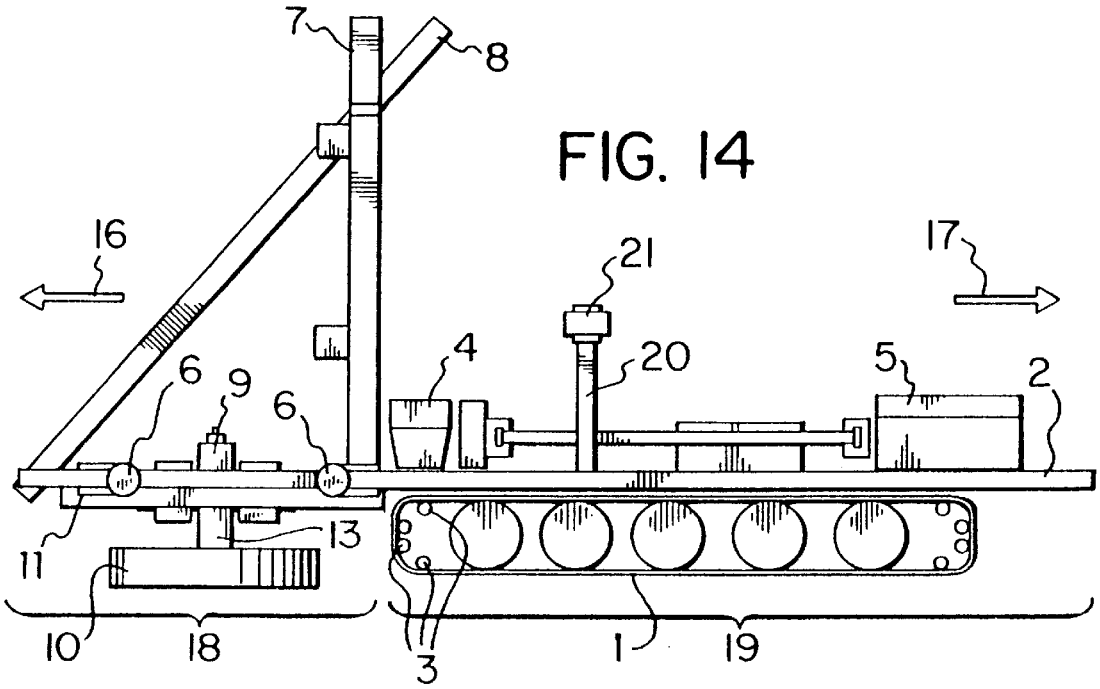
FIG. 14 shows a side view of the fourth embodiment used for cleaning the bottom surface of a pipe.
Figure 15:
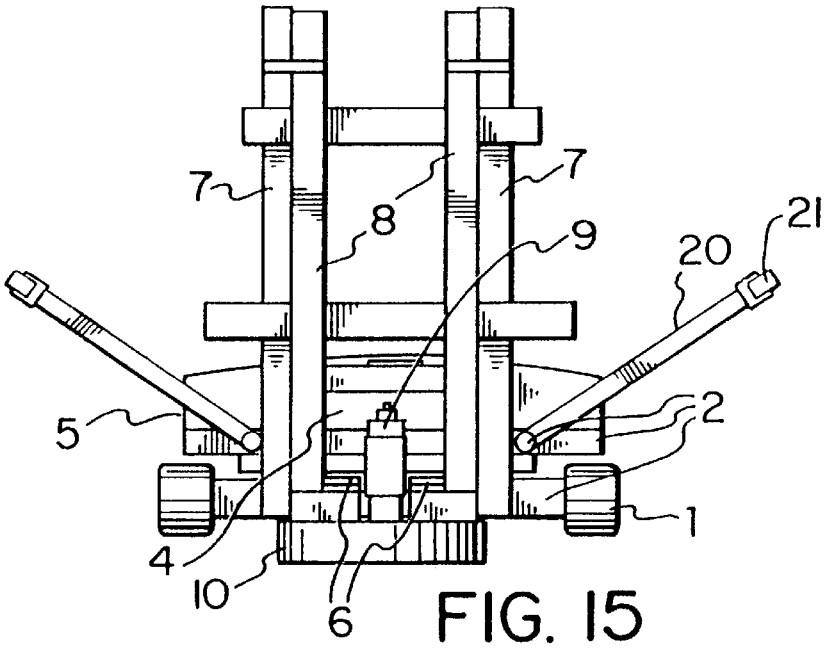
FIG. 15 shows a front view of the fourth embodiment.
Figure 16:
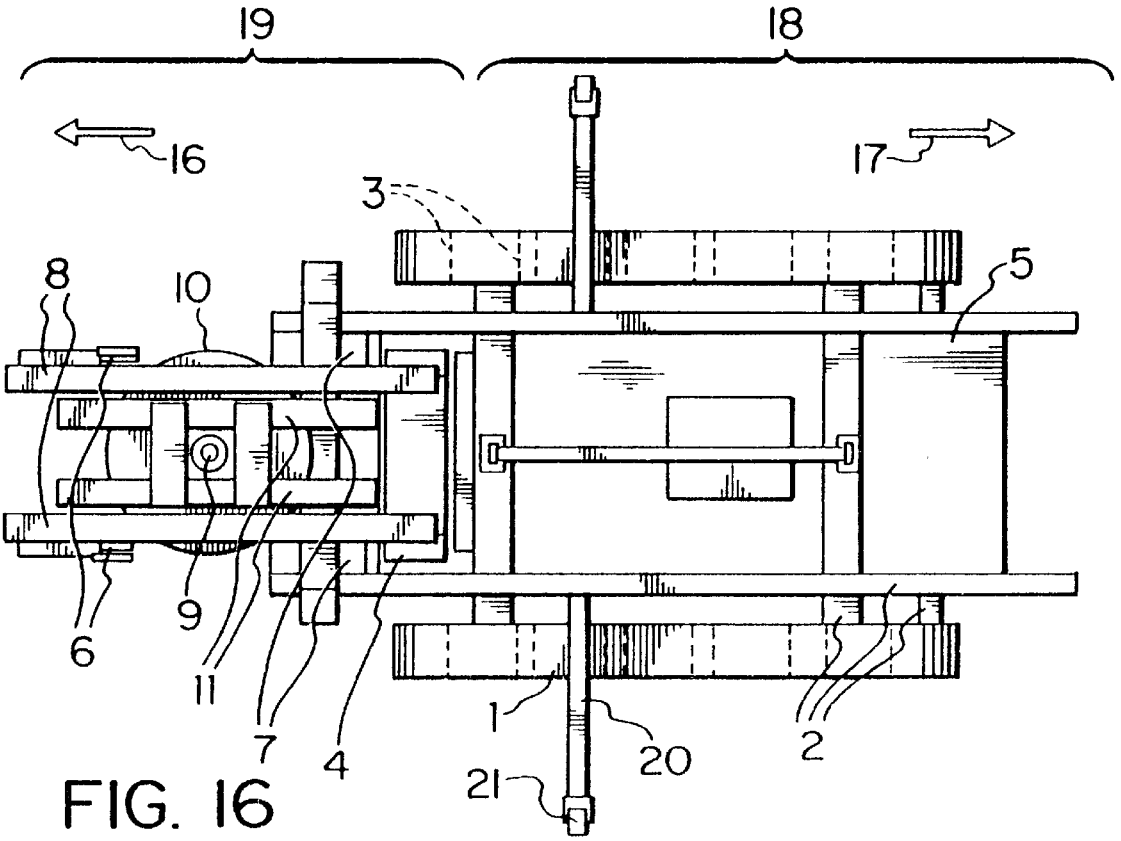
FIG. 16 depicts a top view of the fourth embodiment.

The fourth embodiment is also a combination of the first and second embodiments which is particularly adapted to clean the bottom surfaces of pipelines. The fourth embodiment is depicted in FIGS. 14–16, which show side, front and top views respectively. The principal arm 7 is connected to the front of the chassis 2 as in the second embodiment but the spray nozzle assembly 10 is that of the first.

The vehicle 18, chassis 2, motor (not shown), guiding bars 20, guiding bar attachments 21, battery 4, hydraulic coupler, deadman and drawbar (not shown) are substantially the same as those of the first two embodiments. The cleaning system 19, however, is considerably different. The principal arm 7 is oriented vertically and is essentially the same as the arm in the second embodiment, but it has an additional subsidiary arm 11, which extends horizontally from the principal arm 7. The adjusters 6 move vertically up the principal arm 7 to adjust the height of the subsidiary arm 11. The subsidiary arm 11 holds the spray nozzle assembly 10, and the fluid coupler 9 with flow control valve which are basically the same elements as in the first embodiment. The spray nozzle assembly 10 is outfitted with an exchanger actuator 13, symmetrical branches 14, and spray nozzles 15. Note: these elements are shown in FIGS. 8 and 9. A stabilizing bar 8 extends from the front end of the subsidiary arm 11 to the top end of the principal arm 7 to help stabilize the front of the apparatus when it is carrying the additional weight of the spray nozzle assembly 10.

The vehicle 18 travels longitudinally along the center of the pipe in a direction indicated by arrows 16 or 17, while the branches 14 of the spray nozzle assembly 10 rotate or oscillate, moving the spray nozzles 15 around on the bottom surface of the pipeline. The spray nozzles cut a swath similar to the first embodiment except that the swath is on the bottom surface of the pipe rather than at a radial angle. The fourth embodiment is specifically suited for cleaning the bottom surface of a pipeline.

What is claimed is:

1. An apparatus for cleaning an interior surface of an elongated hollow passageway comprising:

(a) a vehicle having a height and width sufficiently small to enable it to move along an interior of said passageway supported from a bottom half of said passageway, substantially parallel to a longitudinally extending axis of said passageway; and (b) a cleaning assembly connected to said vehicle having a fluid nozzle assembly, said fluid nozzle assembly having an exchanger coupled to an external source of fluid, a plurality of branches coupled to and radially spaced around said exchanger and fluid nozzles coupled to distal ends of respective branches, each of said branches extendible to position respective fluid nozzles proximate the interior surface of said passageway, said fluid nozzle assembly being operative to rotate or oscillate and to emit a jet of fluid from each of said fluid nozzles against the interior surface of said passageway and to scarify the interior surface of said passageway as said vehicle moves along the interior of said passageway, whereby the interior surface of said passageway is scarified to remove a layer of corroded material, contaminates and a portion of an interior surface of said passageway along either a selected region or an entire region of the interior surface of said passageway.

2. The apparatus according to claim 1, wherein said vehicle moves continuously as said cleaning assembly operates.

3. An apparatus according to claim 1, wherein said cleaning assembly cleans a swath parallel to a direction of travel of said vehicle of a width determined by the rotation or oscillation of said fluid nozzle assembly.

4. An apparatus according to claim 1, wherein said exchanger is mounted to a front of said vehicle and said branches extend radially outwardly in a plane transverse to a direction of travel of said vehicle.

5. An apparatus according to claim 1 wherein said elongated hollow passageway is a sewer pipe and wherein said cleaning assembly is readily detachable from said vehicle to allow said vehicle to pass through access openings to said sewer passageway.

6. The apparatus according to claim 1, wherein said vehicle is supported and propelled by a pair of spaced apart tracks.

7. The apparatus according to claim 6, wherein said tracks are laterally adjustable.

8. The apparatus according to claim 1, wherein said branches are telescopically extendible and retractable.

9. The apparatus according to claim 1, including a telescopically extendible guide bar extending out from each side of said vehicle and having a wall engaging attachment at a distal end thereof, each of said guide bars operative to move along an interior surface of pipe and maintain orientation of said vehicle along a longitudinal axis of said elongated hollow passageway.

10. The apparatus according to claim 1, wherein said external source of fluid is a pressurized fluid source remote from said elongated hollow passageway.

11. The apparatus according to claim 1, including a power source located remote from said elongated hollow passageway and coupled to said vehicle.

* * * * *

UNITED STATES PATENT AND TRADEMARK OFFICE

CERTIFICATE OF CORRECTION

PATENT NO. : 6,206,016 B1
DATED : March 27, 2001
INVENTOR(S) : Gerard MacNeil et al It is certified that error appears in the above-identified patent and that said Letters Patent is hereby corrected as shown below:

Column 10,
Line 32, cancel "passageway" and insert -- pipe --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*